US005686707A

United States Patent [19]

Iijima

[11] Patent Number: 5,686,707

[45] Date of Patent: Nov. 11, 1997

[54] ELEVATOR CONTROL SYSTEM TO LAND CAR AT FLOOR DURING ABNORMAL CONDITIONS

[75] Inventor: Atsushi Iijima, Tokorozawa, Japan

[73] Assignee: Kabushiki Kaisha Toshiba, Kawasaki, Japan

[21] Appl. No.: 516,988

[22] Filed: Aug. 18, 1995

[30] Foreign Application Priority Data

Aug. 24, 1994 [JP] Japan ..... 6-199510

[51] Int. Cl.[6] ..... B66B 1/40; B66B 1/28; B66B 1/34

[52] U.S. Cl. ..... 187/291; 187/293; 187/394

[58] Field of Search ..... 187/291, 295, 187/282, 283, 293, 394, 393

[56] References Cited

U.S. PATENT DOCUMENTS

| | | | |
|---|---|---|---|
| 4,245,721 | 1/1981 | Masel | 187/29 R |
| 4,356,896 | 11/1982 | Tamura et al. | 187/29 R |
| 4,515,247 | 5/1985 | Caputo . | |
| 4,520,904 | 6/1985 | Rado et al. | 187/29 R |
| 4,658,935 | 4/1987 | Holland | 187/122 |
| 4,674,604 | 6/1987 | Williams | 187/113 |
| 4,738,337 | 4/1988 | Caputo | 187/115 |
| 4,844,205 | 7/1989 | Klingbeil | 187/116 |
| 4,898,263 | 2/1990 | Manske et al. | 187/133 |

FOREIGN PATENT DOCUMENTS

| | | |
|---|---|---|
| 0 582 170 | 2/1994 | European Pat. Off. . |
| 2 125 190 | 2/1984 | United Kingdom . |

*Primary Examiner*—Robert Nappi

*Attorney, Agent, or Firm*—Oblon, Spivak, McClelland, Maier & Neustadt, P.C.

[57] ABSTRACT

Whenever the elevator cage (2) enters a landing zone at each target stop floor, the landing zone calculator (32) generates discriminate signals (**32*b*, 32*c*, 32*d*) indicative of whether the cage lands from a normal distance or from one of abnormal distances (far away or not far away from the normal distance) detected by limit switches (27 to 30). Then, the landing pattern generator (34) calculates a landing pattern representative of the reference speed proportional to a distance from the current position to the target stop position of the motor shaft on the basis of the output of the landing zone calculator (32**) and the detected motor shaft position. Therefore, whenever the moving cage enters the landing zone, the cage is controlled in such a way that the cage speed can be reduced gradually with the approach of the motor shaft angular position to a target stop angular position thereof.

4 Claims, 6 Drawing Sheets

ELEVATOR CONTROL SYSTEM TO LAND CAR AT FLOOR DURING ABNORMAL CONDITIONS

BACKGROUND OF THE INVENTION

1. Field of the Invention

The present invention relates to an elevator control system.

2. Description of the Prior Art

FIG. 5 shows an example of conventional elevator control systems. In the drawing, a speed command generator 1 generates a speed command signal 1*a* for moving an elevator cage 2 at any speed. The generated speed command signal 1*a* is given to a speed control amplifier 3 as a first input signal. Further, a position detector 5 attached to a motor 4 for driving the cage 2 generates a position signal 5*a* indicative of a motor shaft angular position. A speed detector 6 generates a speed signal 6*a* indicative of a motor speed on the basis of the position signal 5*a*. The generated speed signal 6*a* is given to the speed control amplifier 3 as a second input signal. The speed control amplifier 3 compares the speed signal 6*a* and the speed command signal 1*a*, and outputs a current command 3*a* corresponding to a speed difference between the two signals 6*a* and 1*a* to a current control amplifier 7.

The current control amplifier 7 calculates a difference between the current command 3*a* and a current signal 8*a* indicative of current of the motor 4 detected by a current detector 8. The current control amplifier 7 further calculates a current command 7*a* required to correct the unbalanced torque and to eliminate the current difference between the current command 3*a* and the current signal 8*a*, by adding a current correction signal 9*a* (corresponding to an unbalanced torque and given by an unbalanced torque corrector 9) to the calculated difference. A power converter 10 controls current supplied to the motor 4 on the basis of the current command 7*a*.

On the other hand, a sheave 13 is connected to the motor 4. A main rope 12 is wound around the sheave 13. The cage 2 is hung down from one end of the main rope 12, and a counterweight is hung down from the other end of the main rope 12. The cage 2 is provided with a landing control signal generator 14 for controlling the landing of the cage 2. Further, a plurality of landing detecting plates 15A, 15B, . . are arranged for each floor along an elevator hoist-way. The landing control signal generator 14 outputs a landing control signal 14*a* of analog voltage according to a distance from a reference floor level of the cage 2, whenever the cage 2 approaches each of the landing detecting plates 15A, 15B, . . . arranged for each landing zone at each floor. Each of the landing detecting plates 15A, 15B, . . is formed into a complicated shape (referred to as a boat form) so that the analog voltage signals can be outputted. The landing control signal 14*a* generated by the landing control signal generator 14 is transmitted to the speed command generator 1. On the basis of the transmitted landing control signal 14*a*, the speed command generator 1 outputs the speed command signal 1*a* according to the position in the landing zone at each floor.

Further, the cage 2 is provided with a load sensor 16 for detecting the cage load. The load sensor 16 outputs a load detection signal 16*a* indicative of a cage load to the unbalanced torque corrector 9. The unbalanced torque corrector 9 calculates a current correction signal 9*a* corresponding to an unbalanced torque, so that the unbalanced torque corresponding to a difference between the cage load and the counterweight 11 (previously balanced with the cage load) can be corrected. The calculated current correction signal 9*a* is given to the current control amplifier 7. The current correction signal 9*a* is added to the difference between the current command 3*a* and the current signal 8*a* (detected by the current detector 8), as a correction component, as already explained.

Now, with the advance of microcomputer technology, recently digital control by use of a microcomputer has been widely adopted to control the elevator. In the conventional elevator control system as shown in FIG. 5, the speed command generator 1, the speed control amplifier 3, the speed detector 6 and the current control amplifier 7 all enclosed by dashed lines can be replaced with functions executed by the microcomputer 17.

In this case, the arithmetic section of the microcomputer (which corresponds to the speed command generator 1) generates a landing speed pattern (i.e., reference speed) as shown in FIG. 6. This reference speed is divided into three ranges of time-based pattern range $R_1$ (time from $t_1$ to $t_6$) (calculated on the basis of time), distance-based pattern range $R_2$ (time from $t_6$ to $t_7$) (calculated on the basis of remaining distance to the object floor and calculated in proportion to the square root of the remaining distance), and landing pattern range $R_3$ (time from $t_7$ to $t_8$) (calculated to land the cage smoothly).

In the time-based pattern range $R_1$, the cage 2 is driven in five modes 1 to 5 as follows: The first mode 1 is referred to as an acceleration start jerk mode in which the cage acceleration change rate (jerk) is constant in a positive direction. The second mode 2 is a constant acceleration. The third mode 3 is referred as an acceleration end jerk mode in which the cage acceleration change rate is constant in a negative direction (i.e, the deceleration is constant). The fourth mode 4 is a constant speed travel mode 4 in which the acceleration is zero. And, the fifth mode 5 is referred to as deceleration start jerk mode in which the cage negative acceleration change rate (negative jerk) is constant.

In the distance-based pattern range $R_2$, the cage 2 is driven in a sixth mode 6 in which a negative acceleration (i.e., a deceleration) is constant. Further, in the landing pattern range $R_3$, the cage 2 is driven in a seventh mode 7 in which the positive change rate of the deceleration is constant to reduce the constant deceleration down to zero in such a way that cage 2 can be landed smoothly and securely on the basis of the landing control signal 14*a*.

As described above, in the prior art elevator control system, the speed of the cage 2 is controlled in accordance with the landing speed pattern as shown in FIG. 6 so that the cage 2 can be landed securely and smoothly. In this case, the landing control signal 14*a* used to form the landing speed pattern can be generated by the landing control signal generator 14 attached to the cage 2 in cooperation with the landing detecting plates 15A, 15B, . . arranged on each floor along the hoist-way, as already explained.

In the prior art elevator control system, however, since the landing detecting plates 15A, 15B, . . each formed into a complicated shape are arranged for each floor along the elevator hoist-way, and further since the landing control signal generator 14 is attached to the cage 2, there exists a problem in that the system construction is complicated and thereby the cost thereof is relatively high.

To overcome this problem, another control system which can eliminate the landing detecting plates and the landing control signal generator has been proposed, in which when the entering of the cage 2 into each landing zone is detected by one of limit switches, a difference in distance between the current position and the target stop position of the driving motor shaft is calculated and further, reference speed proportional to the calculated distance is formed as the landing pattern. In this control system, however, when the limit switches for detecting whether the cage enters the landing zone become abnormal, there exists such a disadvantage that it is impossible to stop the cage accurately at the objective floor.

SUMMARY OF THE INVENTION

With these problems in mind, therefore, it is the object of the present invention to provide an elevator control system which can stop the elevator cage at any desired floor securely and smoothly even in case of trouble of the limit switches for detecting the landing zones, respectively at each floor.

To achieve the above-mentioned object, the present invention provides an elevator control system, comprising: motor shaft position detecting means for detecting shaft positions of a motor for driving an elevator cage; speed detecting means for calculating a motor rotational speed on the basis of an output of said motor shaft position detecting means; landing zone detecting means for outputting a landing switch signal indicative of whether the cage enters a landing zone at each floor and further at least one discriminate signal for discriminating whether the elevator cage lands from a normal landing distance or from an abnormal zone other than the normal landing distance; landing pattern generating means for calculating a landing pattern representative of reference speed proportional to a distance between current position and a target stop position of the motor shaft, on the basis of the motor shaft position detected by said motor shaft position detecting means and the discriminate signal outputted by said landing zone detecting means; speed pattern generating means for previously storing a speed pattern of the cage from a starting floor to a stop floor and outputting the stored cage speed pattern; speed pattern switching means for receiving the stored speed pattern and the calculated landing pattern, and outputting the stored speed pattern when the landing switch signal is not received and the calculated landing pattern when the landing switch signal is received; and speed control means for controlling cage speed on the basis of a difference between the output of said speed pattern switching means and the output of said speed detecting means.

In the elevator control system according to the present invention, whenever the elevator cage enters the landing zone at a target stop floor, the landing zone detecting means transmits the discriminate signal to the landing pattern calculating means. The discriminate signal is a signal for discriminating whether the cage lands from the normal distance or from the abnormal distance (far away from or too close to the stop position) all detected by the limit switches. On the basis of the output signal of the landing zone detecting means and the current position of the motor shaft, the landing pattern generating means calculates the reference speed (i.e., the landing pattern) proportional to a distance from the current position to the target stop position. In accordance with the calculated landing pattern, the speed control means controls the cage speed. Further, when the cage is driven for the ordinary travel (out of the landing zone), the cage speed is controlled in accordance with a previously determined and stored speed pattern.

According to the present invention, whenever the elevator cage reaches the landing zone, since the speed pattern (the reference speed) proportional to the distance from the current position to the target stop position of the motor shaft is calculated under due consideration of the trouble of the landing (limit) switches, and further since the landing is controlled in accordance with the calculated speed pattern, it is possible to stop the cage at any desired stop position accurately and smoothly, even if the landing switches are not normal. Further, since the complicated landing detecting plates are not used and the landing control signal generator is not mounted on the cage, it is possible to realize an advantageous elevator landing control system at a low cost.

DETAILED DESCRIPTION OF THE PREFERRED EMBODIMENTS

Figure 1:
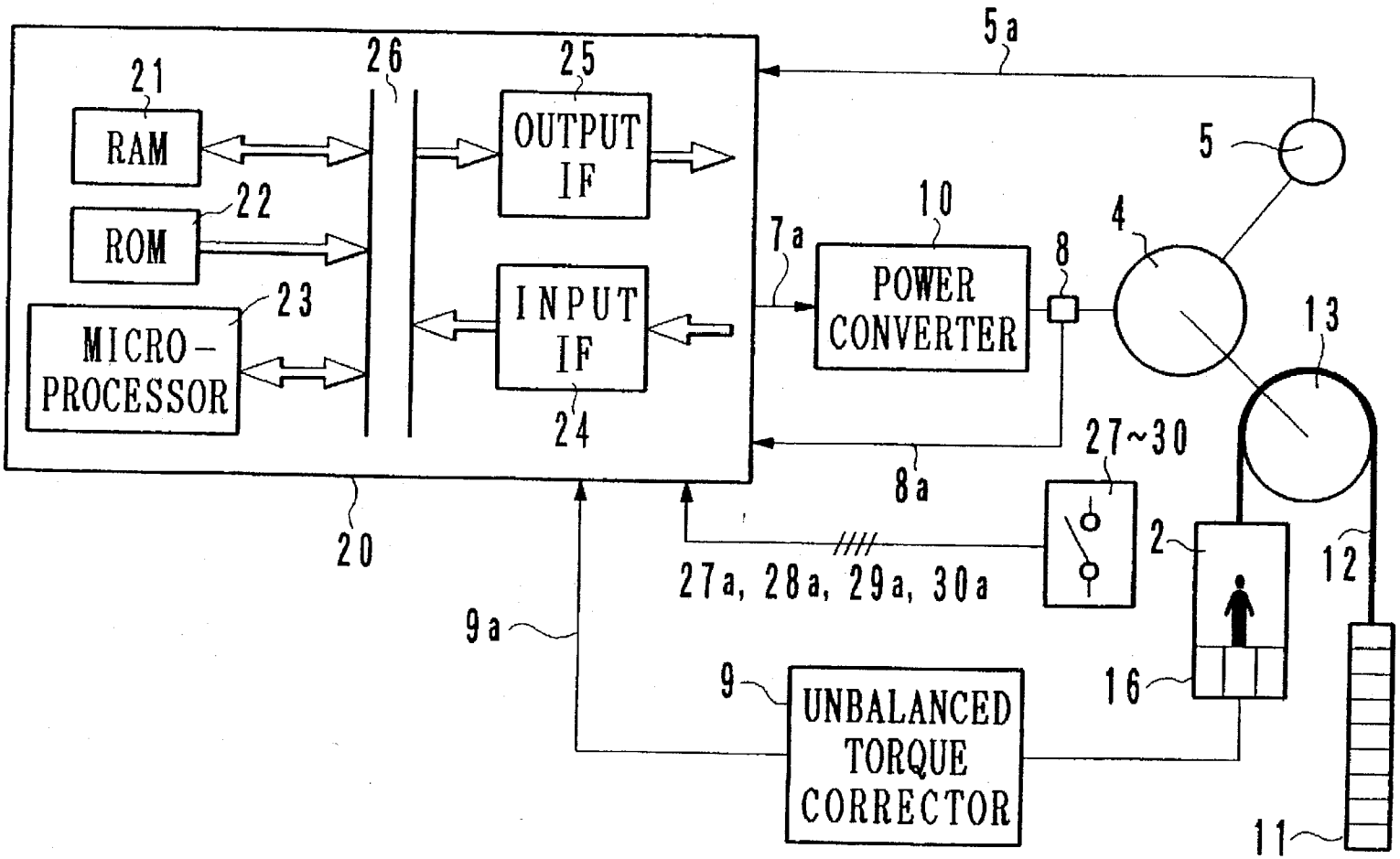
FIG. 1 is a schematic block diagram showing an entire construction of the elevator control system according to the present invention.
Figure 5:
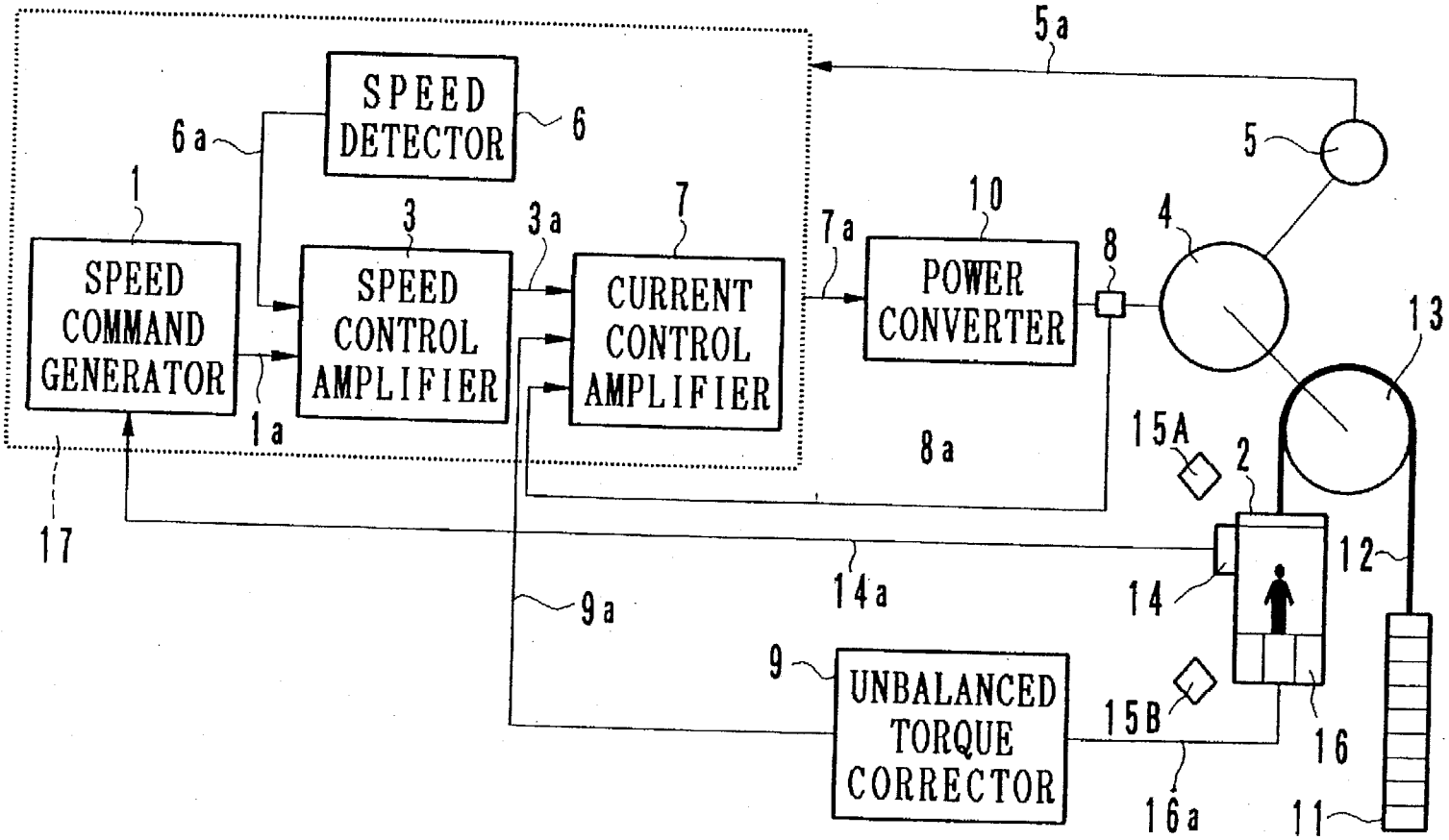
FIG. 5 PRIOR ART
FIG. 5 is a block diagram showing a prior art elevator control system.

An embodiment of the elevator control system according to the present invention will be explained hereinbelow with reference to the attached drawings. FIG. 1 shows an entire system construction of the embodiment, in which the same reference numerals have been retained for the similar elements which have the same functions as with the case of the prior art control system shown in FIG. 5.

The feature of the present embodiment is to include a control apparatus 20 constructed by a microcomputer. The control apparatus 20 (i.e., hardware) is provided with a microprocessor 23, a ROM 22 for storing programs, a RAM 21 for storing contents of the arithmetic results temporarily, an input interface 24 for reading input signals, and an output interface 25 for outputting output signals. These above-mentioned elements are all connected to each other via a data bus 26.

On the other hand, a plurality of landing switches 27 to 30 are arranged at each floor along the elevator hoist-way. The landing switches 27 to 30 output turn-on detection signals 27*a*, 28*a*, 29*a* and 30*a*, respectively according to the cage position, whenever the cage 2 reaches each floor. In this embodiment, each of the landing switches 27 to 30 is not of a complicated type as is conventional, but is of a simple construction type simply turned on or off whenever the cage 2 passes therethrough, with the result that an increase in cost can be suppressed.

Figure 2:
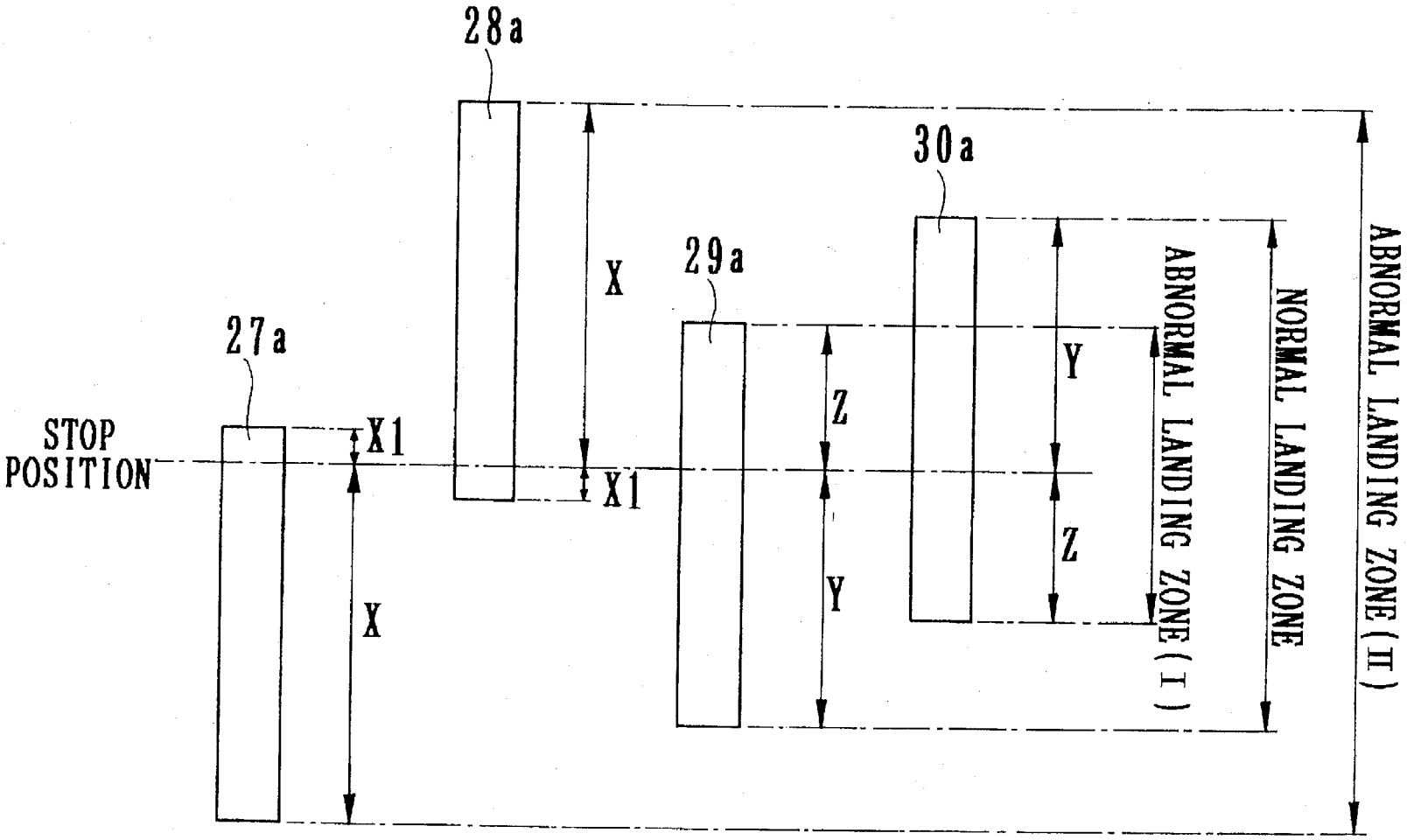
FIG. 2 is an illustration for assistance in explaining an example of the operation timings of the landing switch.

FIG. 2 shows an example of the turn-on conditions of the respective landing switches 27 to 30. In FIG. 2, the switch 27 outputs the turned-on detection signal 27*a* when the cage 2 is moving between a lower position a distance X (mm) downward away from the stop position and an upper position a distance X1 (mm) (X1<X) upward away from the cage stop position. In the same way, the switch 28 outputs the turned-on detection signal 28*a* when the cage 2 is moving between a lower position a distance X1 (mm) downward away from the stop position and an upper position a distance X (mm) (X1<X) upward away from the cage stop position. The switch 29 outputs the turned-on detection signal 29*a* when the cage 2 is moving between a lower position a distance Y (mm) downward away from the stop position and an upper position a distance Z (mm) (X>Y>Z) upward away from the cage stop position. Further, the switch 30 outputs the turned-on detection signal 30*a* when the cage 2 is moving between a lower position a distance Z (mm) downward away from the stop position and an upper position a distance Y (mm) (X>Y>Z) upward away from the cage stop position. Further, in FIG. 2, the landing zone from the lower distance Z to the upper distance Y indicates a normal landing zone, the landing zone from the lower distance Z to the upper distance Z indicates a first abnormal landing zone (I), and the landing zone from the lower distance X to the upper distance X indicates a second abnormal landing zone (II), respectively.

Figure 3:
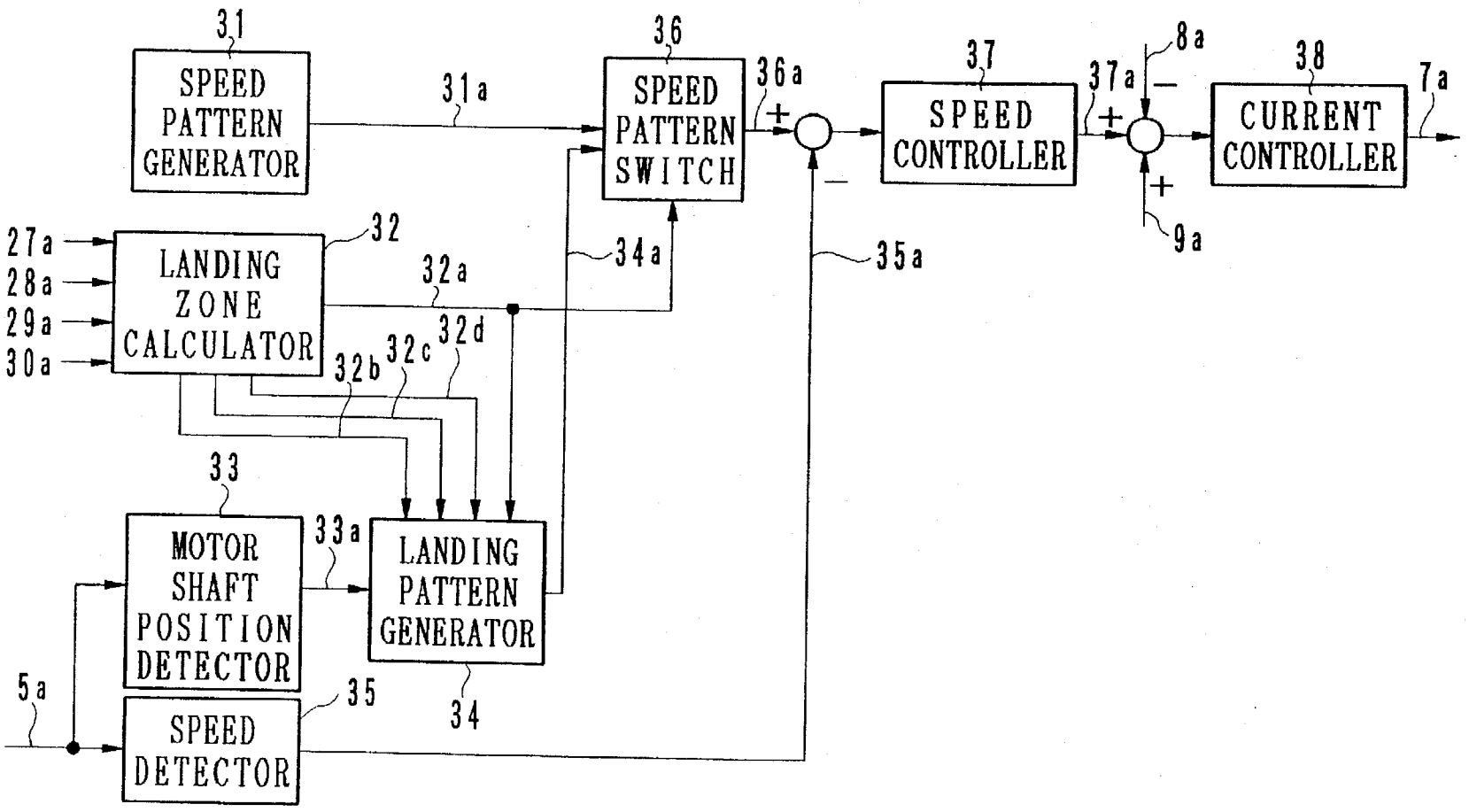
FIG. 3 is a block diagram showing an embodiment of the elevator control system according to the present invention.

FIG. 3 shows the functions of the microprocessor 23 (shown in FIG. 1) in detail. The microprocessor 23 is provided with the functions as a speed pattern generator 31, a landing zone calculator 32, a motor shaft position detector 33, a landing pattern generator 34, a speed detector 35, a speed pattern switch 36, a speed controller 37, and a current controller 38.

The speed pattern generator 31 calculates the ordinary speed pattern 31*a*. The landing zone calculator 32 outputs the landing switch signal 32*a* and the landing zone discriminate signals 32*b*, 32*c* and 32*d*. The motor shaft position detector 33 outputs the motor shaft position data 33*a*. The landing pattern generator 34 calculates the landing pattern (reference speed) 34*a* in the landing zone on the basis of the motor shaft position data 33*a* given by the motor shaft position detector 33 and the landing switch signal 32*a* and the landing zone discriminate signals 32*b*, 32*c* and 32*d* given by the landing zone calculator 32.

Here, the signal 32*b* represents the landing from an abnormal landing zone (I) (a first abnormal zone within the normal landing distance) as shown in FIG. 2, the signal 32*c* represents the landing from a normal landing zone, and the signal 32*d* represents the landing from an abnormal landing zone (II) (a second abnormal zone out of the normal landing zone).

The speed detector 35 converts the position signal 5*a* given by the position detector 5 into the speed signal 35*a*. The speed pattern switch 36 switches the ordinary speed pattern 31*a* to the landing pattern 34*a* when the cage enters the landing zone. The speed controller 37 compares the speed signal 35*a* given by the speed detector 35 with the reference speed 36*a* given by the speed pattern switch 36, and outputs a current command 37*a* for reducing the speed difference between the two down to zero. The current controller 38 adds the current correction signal 9*a* given by the unbalanced torque corrector 9 to the difference between the current command 37*a* obtained by the speed controller 37 and the current signal 8*a* obtained by the current detector 8, and outputs the current command 7*a* on the basis of the comparison result. Therefore, the current of the motor 4 can be controlled through a power converter 10 on the basis of the current command 7*a* outputted by the current controller 38 (i.e., the control apparatus 20), with the result that it is possible to obtain any desired elevator speeds.

The landing control by the control apparatus 20 as described above will be explained hereinbelow.

Figure 6:
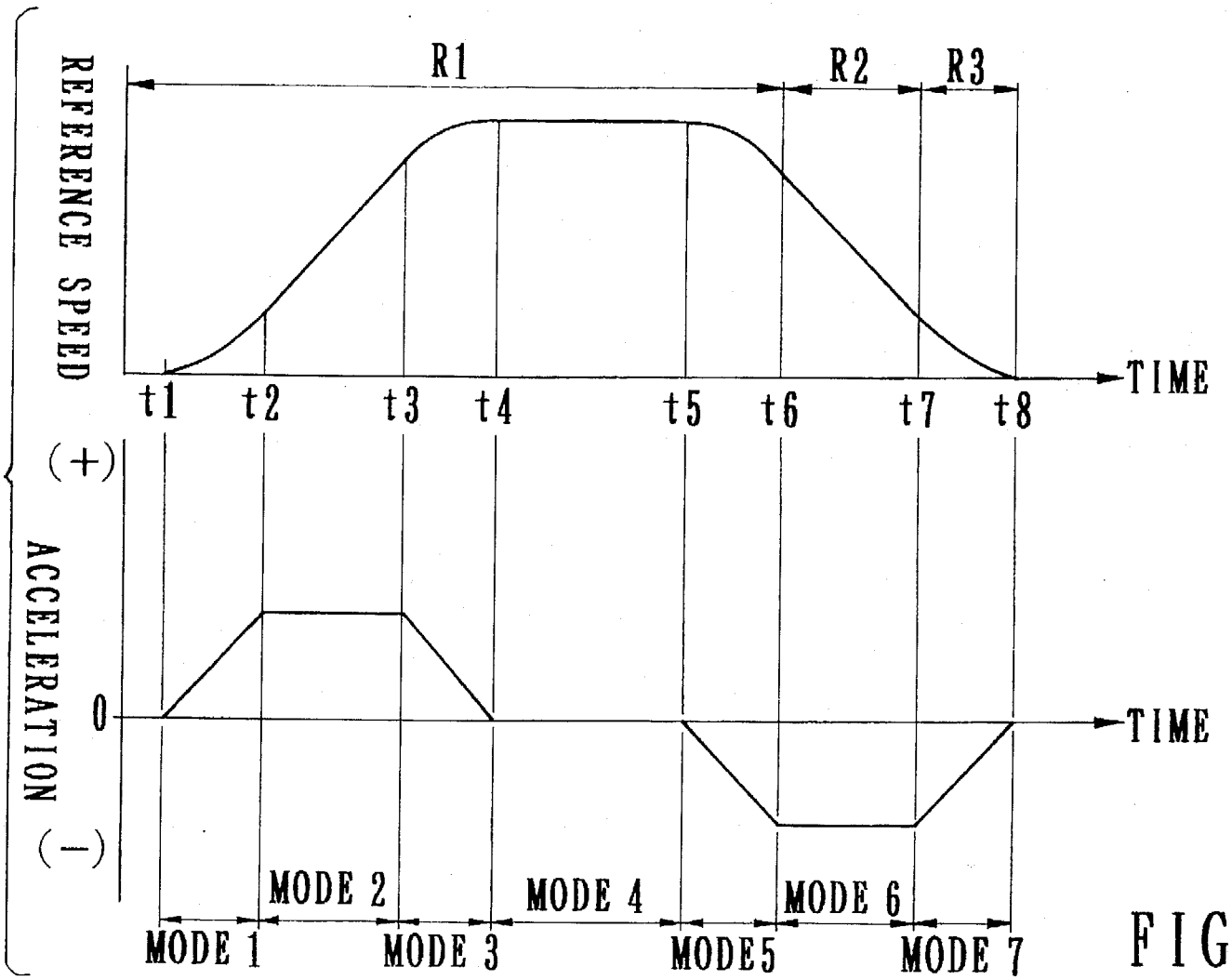
FIG. 6 PRIOR ART
FIG. 6 is a graphical representation showing typical elevator speed pattern characteristics.

When the elevator cage reaches a landing zone of a floor at time $t_7$ in FIG. 6, since the microprocessor 23 receives the detection signals 27*a* to 30*a* of the landing switches 27 to 30 arranged at each floor along the hoist-way, the landing zone calculator 32 outputs the landing switch signal 32*a* and the landing zone discriminate signals 32*b*, 32*c* and 32*d*. In this case, in the normal cage landing, when the cage 2 reaches a lower position a distance Y (mm) downward away from the stop position, the landing zone calculator 32 outputs the switch signal 32*a* and the discriminate signal 32*c* (normal). However, in case a defective contact (off-mode trouble) occurs in the limit switch 29 when the cage is moving in the upward direction, the signal 29*a* is not turned on even when the cage 2 reaches the lower position a distance Y (mm) away from the stop position, so that the landing zone cannot be detected. In this case, however, the landing zone calculator 32 outputs the switch signal 32*a* and the discriminate signal 32*b* (indicative of the landing from the abnormal landing zone (I)) when the cage 2 reaches the lower position a distance Z (mm) away from the stop position. In addition, when the occurrence of the off-mode trouble of the limit switch 29 and 30 as shown in FIG. 1 has been previously known, the landing zone calculator 32 outputs the switch signal 32*a* and the discriminate signal 32*d* (indicative of the landing from the abnormal landing zone (II)) when the cage 2 reaches the lower position a distance X (mm) away from the stop position. As described above, the landing zone calculator 32 outputs the switch signal 32*a* and any one of the discriminate signals 32*b*, 32*c* and 32*d* indicative of from which position away from the target stop position the cage 12 begins to land, on the basis of the defective contact (off-mode trouble) or the fusion contact (on-mode trouble) of the landing switches 29 to 30.

The motor shaft position detector 33 outputs data 33*a* representative of the motor shaft angular position on the basis of the output signals 5*a* of the position detector 5 (e.g., a brush-less resolver or pulse generator). In response to the motor shaft angular position data 33*a*, the landing switch signal 32*a* and the landing zone discriminate signal 32*b*, 32*c* or 32*d*, the landing pattern generator 34 calculates the landing pattern within the landing zone as follows:

If the motor shaft angular position data 33*a* (i.e., motor shaft angle) obtained when the landing switch signal 32*a* is turned on (when the cage enters the landing zone) is denoted by $\theta_o$, the motor shaft angle $\theta_p$ at the target stop position can be expresses as $$\theta_p=\theta_o\pm\theta_c \tag{1}$$

where $\theta_c$ denotes a change of the motor shaft angle after the cage enters the landing zone and ± is determined by the upward or downward motion of the elevator. Here, $\theta_c$ can be obtained by the following formula:

$$\theta_c=A\cdot P/(\pi\cdot D) \tag{2}$$

where P (mm) denotes a travel distance per each one revolution of the motor shaft, and D (mm) denotes a diameter of the sheave 13, and A (mm) denotes the set distance of the landing zone. Therefore, $\theta_c$ can be previously calculated as follow:

when landing from the abnormal landing zone (I) (the signal 32*b* is on), $$\theta_c=\theta_{c1}=P\cdot Z/(\pi\cdot D) \tag{3}$$

when landing from the normal landing zone (the signal 32*c* is on), $$\theta_c=\theta_{c2}=P\cdot Y/(\pi\cdot D) \tag{4}$$

when landing from the abnormal landing zone (II) (the signal 32*d* is on), $$\theta_c=\theta_{c3}=P\cdot X/(\pi\cdot D) \quad (5)$$

After that, the landing pattern generator 34 momentarily calculates the angular deviation $\Delta\theta$ between the motor shaft angle data 33*a* (after the landing switch signal 32*a* is turned on) and the target stop position as $$\Delta\theta=\theta_p-\theta_x \quad (6)$$

and further the reference speed V is calculated by multiplying the angular deviation $\Delta\theta$ calculated by the formula (6) by a gain G as $$V=G\cdot\Delta\theta=G\cdot(\theta_p-\theta_x) \quad (7)$$

In summary, at the landing, a linear landing pattern is calculated on the basis of the deviation $\Delta\theta=\theta_p-\theta_x$ of the motor shaft, and the calculated landing pattern is outputted by the landing pattern generator 34, as the reference speed signal 34*a*. When the linear relationship between the angular deviation $\Delta\theta$ and the reference speed is rewritten into the relationship between the time and the reference speed, it is possible to obtain the jerk-mode curve as shown in FIG. 6.

In response to the landing switch signal 32*a*, the speed pattern switch 36 outputs the output signal 31*a* given by the speed pattern generator 31 until time $t_7$ (shown in FIG. 6) but the output signal 34*a* given by the landing pattern generator 34 from time $t_7$ to time $t_8$ (shown in FIG. 6), as the output signal 36*a*. Further, the speed controller 37 calculates a proportional-plus-integral (PI) value of the deviation between the reference speed signal 36*a* and the speed signal 35*a*, and outputs the control signal 37*a*.

After having been further corrected on the basis of the difference between the current signal 8*a* and the current correction signal 9*a*, the control signal 37*a* is given to the current controller 38. The output 7*a* of the current controller 38 is applied to the power converter 10. The power converter 10 supplies the current corresponding to the signal 7*a* to the motor 4. As described above, the motion of the elevator cage 2 can be controlled by the motor 4 so that the elevator cage 2 can be stopped at any desired target stop position accurately and smoothly.

Figure 4:
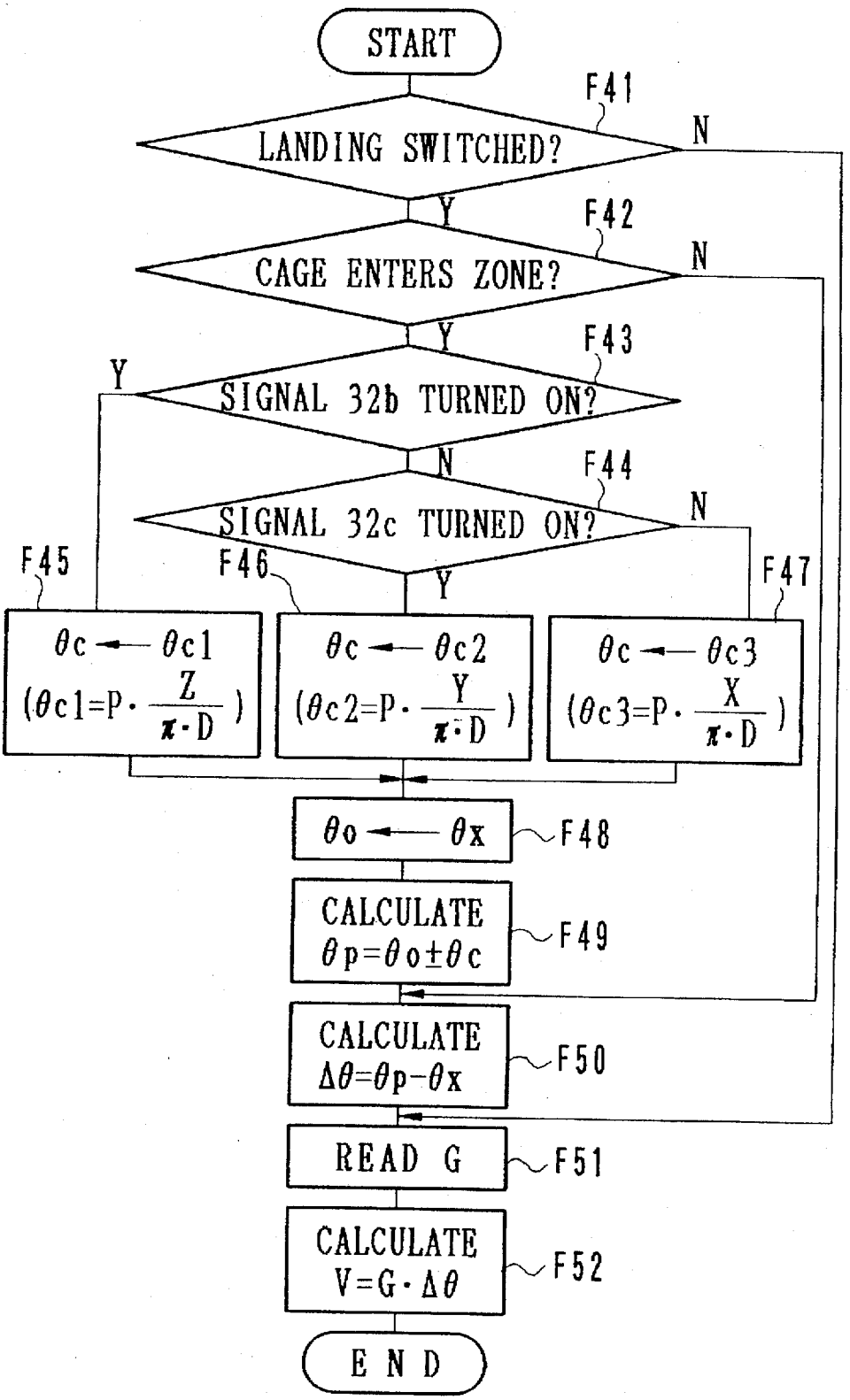
FIG. 4 is a flowchart for assistance in explaining the operation of the landing pattern generator of the control system according to the present invention.

FIG. 4 is a flowchart showing the operation of the landing pattern arithmetic section 34. In step F41, the microprocessor 23 (referred to as control, hereinafter) discriminates whether the landing is switched (starts) or not on the basis of the landing switch signal 32*a*. In step F42, if switched; that is, if within the landing zone, control discriminate whether the cage enters the landing zone or not. The entering to the landing zone of the cage can be discriminated by checking whether a flag (turned on when the cage enters the landing zone) is turned on or not. If the cage enters the landing zone, in step F43, control discriminate whether the landing starts from the abnormal landing zone (I) or not. If YES, control proceeds to step F45. If NO in step F43, control proceeds to step F44 to further discriminate whether the landing starts from the normal landing zone or not. If YES, control proceeds to step F46; and if NO (since this indicates that the landing starts from the abnormal landing zone II), control proceeds to step F47. In step F45, control reads the previously set angular change rate $\theta_c$ of the motor shaft obtained when the cage lands from the abnormal landing zone (I) as expressed by the formula (3). In step F46, control reads the previously set angular change rate $\theta_c$ of the motor shaft obtained when the cage lands from the normal landing zone as expressed by the formula (4). In step F47, control reads the previously set angular change rate $\theta_c$ of the motor shaft obtained when the cage lands from the abnormal landing zone (II) as expressed by the formula (5). In step F48, control saves the motor shaft angular data $\theta_x$ obtained when the cage enters the landing zone as $\theta_o$. Further, in step F49, control calculates the motor shaft angle $\theta_p$ at the target stop position. After the cage enters the landing zone, in step F50, control calculates the angular deviation $\Delta\theta$ between the motor shaft angle and the target stop position within the landing zone in accordance with the formula (6). Further, in step F51, control reads a previously set gain G. In step F52, control calculates the reference speed V (i.e., landing pattern signal 34*a*) in accordance with the formula (7).

Further, when the detection position of the landing switches differs between when the elevator moves in the upward direction and when moves in the downward direction, it is possible to overcome this problem by setting different values to the upward and downward motor shaft angular change rates ($\theta_c$) from when the cage enters the landing zone to when reaches the target landing position, respectively.

What is claimed is:

1. An elevator control system, comprising:

motor shaft position detecting means for detecting shaft positions of a motor for driving an elevator cage;

speed detecting means for calculating a motor rotational speed on the basis of an output of said motor shaft position detecting means;

landing zone detecting means for detecting whether the cage enters a landing zone at each floor to output a landing switch signal and to output a discrimination signal indicative of whether the elevator cage lands from a normal landing distance or from an abnormal zone other than the normal landing distance;

landing pattern generating means for calculating a landing pattern representative of a reference speed proportional to a distance between a current position and a target stop position of the motor shaft, on the basis of the motor shaft position detected by said motor shaft position detecting means and the discrimination signal outputted by said landing zone detecting means;

speed pattern generating means for previously storing a speed pattern of the cage from a starting floor to a stop floor and outputting the stored cage speed pattern;

speed pattern switching means for receiving the stored speed pattern and the calculated landing pattern, and outputting the stored speed pattern when the landing switch signal is not received and the calculated landing pattern when the landing switch signal is received; and speed control means for controlling cage speed on the basis of a difference between the output of said speed pattern switching means and the output of said speed detecting means.

2. The elevator control system of claim 1, wherein said landing pattern generating means calculates the target stop positions of the motor shaft in both elevator upward and downward motion directions, separately, to calculate the landing patterns on the basis of the calculated target stop positions.

3. The elevator control system of claim 2, wherein said landing zone detecting means comprises:

a first switch for detecting that the cage enters a landing zone at each floor and outputting the landing switch signal;

a second switch for outputting a signal indicative of the landing from the normal landing distance;

a third switch for outputting a signal indicative of the landing from the abnormal landing distance far away from the normal distance; and a fourth switch for outputting a signal indicative of the landing from the abnormal landing distance not far away from the normal distance; and wherein said landing pattern generating means calculates the landing pattern according to which switch of said landing zone detecting means is operative.

4. The elevator control system of claim 1, wherein a single microcomputer is used to execute each function of said motor shaft position detecting means, said speed detecting means, said landing zone detecting means, said landing pattern generating means, said speed pattern generating means, said speed pattern switching means, and said speed control means.

* * * * *